United States Patent [19]

Griffin, Jr.

[11] Patent Number: 4,631,874

[45] Date of Patent: Dec. 30, 1986

[54] BLEACHER STRUCTURE

[76] Inventor: Jewell C. Griffin, Jr., Rte. #2, Box 89, Cottondale, Fla. 32202

[21] Appl. No.: 726,486

[22] Filed: Apr. 24, 1985

Related U.S. Application Data

[63] Continuation of Ser. No. 457,002, Jan. 10, 1983, abandoned.

[51] Int. Cl.[4] ..... E04H 3/12; E04G 5/08

[52] U.S. Cl. ..... 52/8; 52/188; 52/191; 182/222; 182/228

[58] Field of Search ..... 52/8, 188, 191, 182; 182/222, 228; 248/250, 510

[56] References Cited

U.S. PATENT DOCUMENTS

| | | | |
|---|---|---|---|
| 1,624,721 | 4/1927 | Duke | 52/8 |
| 1,715,885 | 6/1929 | Annand et al. | 52/8 |
| 1,809,598 | 6/1931 | Oberdorfer et al. | 52/8 |
| 2,503,363 | 4/1950 | Torkelson | 52/8 |
| 3,117,350 | 1/1964 | Margadant | 52/191 |
| 3,482,874 | 12/1969 | Henebry et al. | 52/8 |
| 3,490,393 | 1/1970 | Nelson | 248/250 |
| 3,932,972 | 1/1976 | Rossman | 52/188 |
| 4,011,695 | 3/1977 | Simmons, Sr. | 52/8 |
| 4,126,354 | 11/1978 | Delong et al. | 52/8 |
| 4,307,914 | 12/1981 | Grandclement | 52/8 |
| 4,345,406 | 8/1982 | Motley | 52/8 |
| 4,441,680 | 4/1984 | Rivkin et al. | 248/510 |

FOREIGN PATENT DOCUMENTS

| | | | |
|---|---|---|---|
| 0014155 | 8/1980 | European Pat. Off. | 182/222 |
| 2809704 | 9/1979 | Fed. Rep. of Germany | 52/191 |

*Primary Examiner*—Carl D. Friedman
*Assistant Examiner*—Michael Safavi
*Attorney, Agent, or Firm*—Arthur G. Yeager

[57] ABSTRACT

A bleacher structure for spectators comprising a system of interconnected upright posts crossbeams, and diagonal stiffening members with channel beam seats and footrests locked into the structure by means of tab members in the crossbeams and clips bolted to the crossbeams.

9 Claims, 6 Drawing Figures

BLEACHER STRUCTURE

This is a continuation of co-pending application Ser. No. 457,002 filed on Jan. 10, 1983, now abandoned.

BACKGROUND OF THE INVENTION

Bleacher structures have been used for many years to hold spectators at sporting events, meetings, etc. In the case of bleachers that can be readily assembled and disassembled there has always been a problem of handling the weight of the components of the structure and the expense of assembling and disassembling the structure. Because of the necessity of making a structure strong enough and rigid enough to hold spectators it has normally been found desirable to use heavy components and to securely bolt such components into place. In more recent times it has been found that extruded metal shapes that are light in weight and yet are strong can be employed for these structures. In U.S. Pat. No. 4,011,695 there is disclosed a structure employing channel beams, circular posts, and extruded channel beam shapes as the seats and footrests of the structure. The seats in the footrest are identical extruded shapes but are assembled in different ways when used as a footrest than when used as a seat.

In U.S. Pat. No. 4,345,406 there is disclosed an improved design wherein the seatrests are of a different design than the footrests although both employ fastening means comprising hook members on the seats and the footrests to snap lock into place in cooperating holes in the upright posts and in the crossbeams of the structure, thus eliminating the neccessity for using bolts in many attachment locations. The present invention is designed to be an improvement over the structure in U.S. Pat. No. 4,345,406. In replacing the fastening means involving hook members that snap lock into place by the combination of a tab in the crossbeam to hold one edge of the seat or footrest in place and a clip to be bolted to the crossbeam to hold the other portion of the seat or footrest in place. One of the advantages of the present system is that both the seat and the footrest are of identical construction and thus there is no need to be concerned about which channel beam is to be employed as a footrest and which one is employed as a seat. It is also an object of this invention to provide a novel bleacher structure system which is readily assembled and which is light in weight. It is still another object to provide seats and footrests that have no cuts or notches that might weaken the structure and to have tight connections at each point. Still other objects will be apparent from the more detailed description of the invention which follows.

BRIEF SUMMARY OF THE INVENTION

This invention provides a bleacher structure having channel beam seat members and channel footrest members supported by an interconnected system of upright posts being rectangular in cross section and having lateral cross support members adjacent the upper ends thereof, crossbeams interconnecting adjacent posts, and diagonal stiffening members, said seat members and said footrest members having an upper horizontal web portion and a plurality of spaced vertical leg portions depending from the web portions, including one outer leg portion positioned at each of the two outer extremities of said horizontal web portions, each of said leg poritons terminating in a foot portion, the outer bearing surfaces of said foot portions being substantially coplanar, each foot protion of said outer legs extending toward each other and including an upwardly directed bead, said lateral cross support members and said crossbeams each having an upwardly extending tab adapted to receive one of said beads and a removable clip fastenable to said member or said beam and adapted to receive the other of said beads and clamp said channel member to said support member or said crossbeam respectively. In two alternative embodiments of this invention the removable chip is an S-shaped structure or a U-shaped structure. In a particularly preferred embodiment of this invention the footrest member and the seat member are both of identical shape and size.

BRIEF DESCRIPTION OF THE DRAWINGS

The novel features believed to be characteristic of this invention are set forth with particularly in the appended claims. The invention, however, both as to its organization and method of operation, together with further objects and advantages thereof, may best be understood by reference to the following description taken in connection with the accompanying drawings in which:

DETAILED DESCRIPTION OF THE INVENTION

Figure 1:
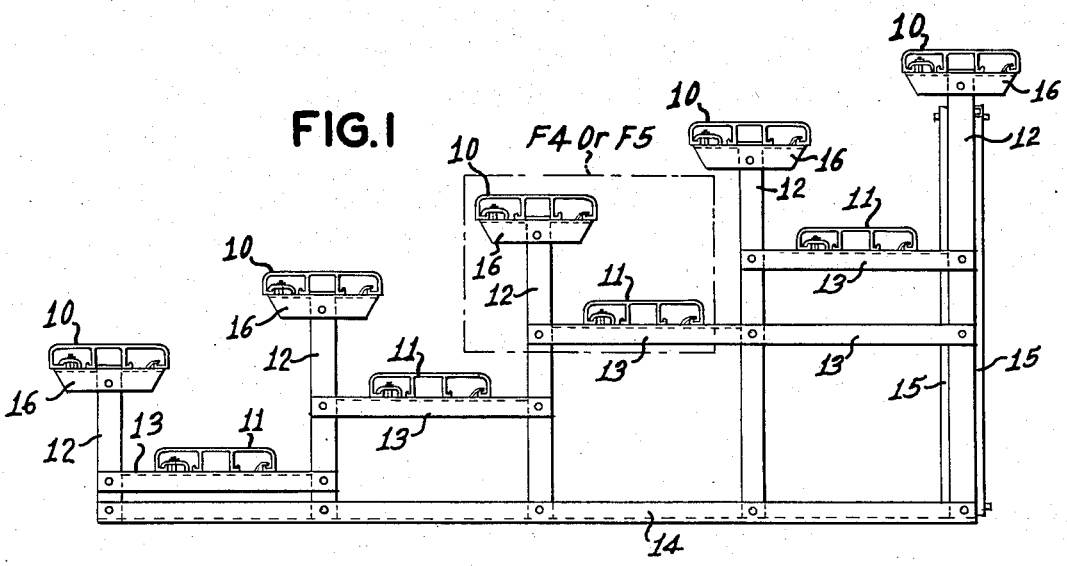
FIG. 1 is an end view in elevation of the bleacher structure of this invention.
Figure 2:
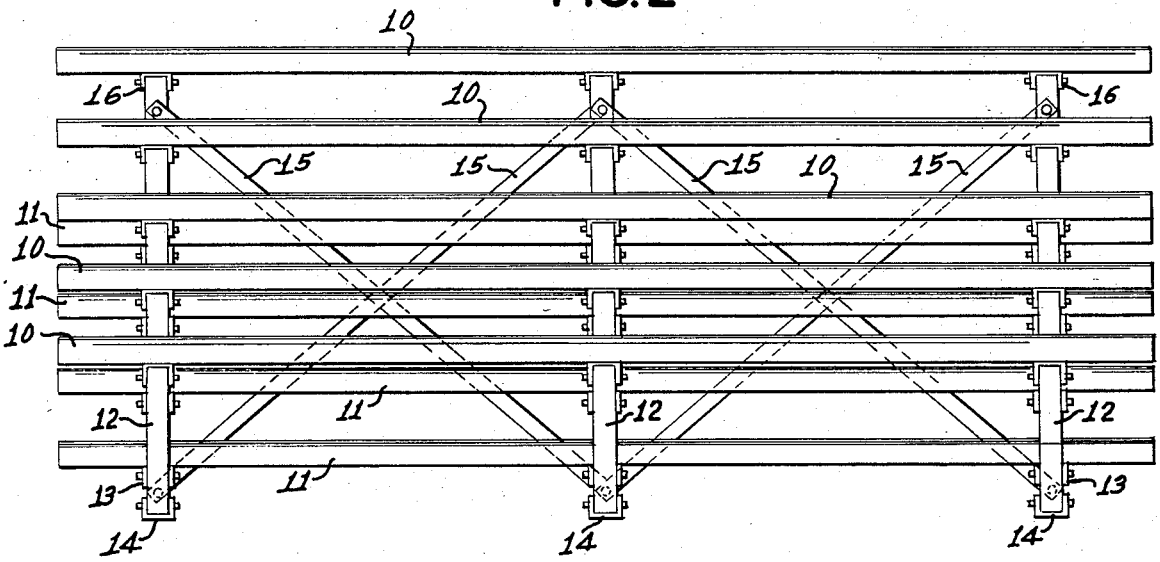
FIG. 2 is a front view in elevation of the bleacher structure of this invention.

With specific reference to FIGS. 1 and 2 the general structure of the bleacher of this invention can be understood. Each bleacher unit is generally made of three or more sets of upright supports across which are laid the seat members and the footrest members. The upright posts in each set of upright supports vary in length such that the shorter posts are in the front and the longer posts are in back to provide adequate viewing by the spectators. A system of crossbeams join adjacent upright posts to hold them in a rigid position and a base support structure of some kind is provided to prevent any post from sinking into the ground and causing the entire structure to be unstable and not level. Diagonal stiffening members are normally placed across the back of the structure in order to provide an increased rigidty and to hold the sets of upright supports in a selected spacing from each other. There is no criticality with respect to the particular design of joining upright posts with crossbeams and with diagonal stiffening members although the one disclosed in FIGS. 1 and 2 is a preferred structure.

Each set of vertical upright support members comprises a series of upright posts 12 of increasing length as the post is used from the front to the back of the bleacher structure. A series of crossbeams 13 are fastened to adjacent upright posts 12 so as to maintain them in a selected spaced arrangement and vertical position. The entire set of each supporting structure rests on a channel beam base member 14 which is sufficiently large in area to support the weight of the structure plus the spectators and not bury itself into the ground upon which this structure rests and thereby permit this structure to tilt or to become otherwise unstable. Each set of upright supporting structure can be completely disassembled or alternatively the structure can be made into a rigid unitary arrangement by welding or otherwise permanently fastening the upright post to the crossbeams and to the base member.

Figure 3:
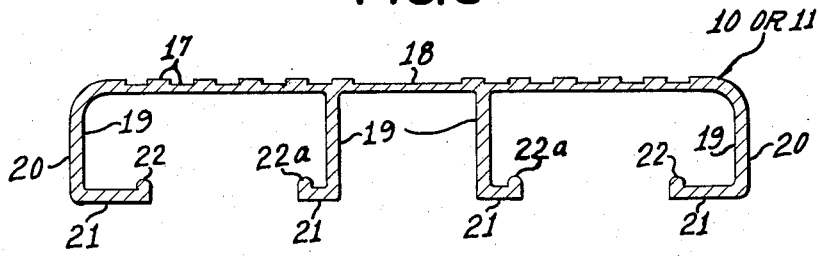
FIG. 3 is an end view of the channel beam seat member or the channel beam footrest member of this invention.

Three or more of the upright supporting structures are assembled into a single bleacher structure by attachement of diagonal stiffening members 15 which may be bolted or otherwise attached to the rearmost upright post 12 in each set of supporting structures. At the top of each upright post 12 there is attached a lateral cross support member 16 by a bolt or other fastening means. Channel beam seat members are then attached to the tops of respective upright posts 12 and lateral cross support members 16, and channel beam footrest members 11 are attached to respective crossbeams 13 to produce the structure shown in FIG. 2. In FIG. 3 there is shown an end view of the channel beam seat member 10 and or the channel beam footrest member 11. In the preferred embodiment of this invention these members are identical in structure so as to provide less confusion in the assembly of the bleacher structure of this invention. Each channel beam member 10 or 11 has a horizontal upper web portion 18 from which depend vertically a plurality of leg portions 19, of which at least two leg portions are positioned at the outer extremities, repsectively, of horizontal web portion 18 and are identified as outer leg portions 20. There must be at least two poritons 19 or 20 and it is not critical how many there may be in excess of two although the preferred embodiments as shown in FIG. 3 is to have two leg portions 19 and two outer leg portions 20 forming a generally symmetrical structure. At the lower extremities of each leg portion 19 or 20 there is formed a foot portion 21 with the lower surfaces of each foot portion 21 being coplanar. At the end of each portion 21 there is formed an upwardly extending bead 22 on at least the foot portions of legs 20. As shown in FIG. 3 a bead **22*a* is preferably also formed on the foot portions of inrterior legs 19 although this is not an important or necessary featre of this invention. The upper surface of horizontal web portion 18 is preferably formed with a tread of parallel grooves or flutes 17 to provide a non slippery traction for spectators walking on channel beams 10 and 11** when getting to or leaving from a seat on the structure.

Figure 4:
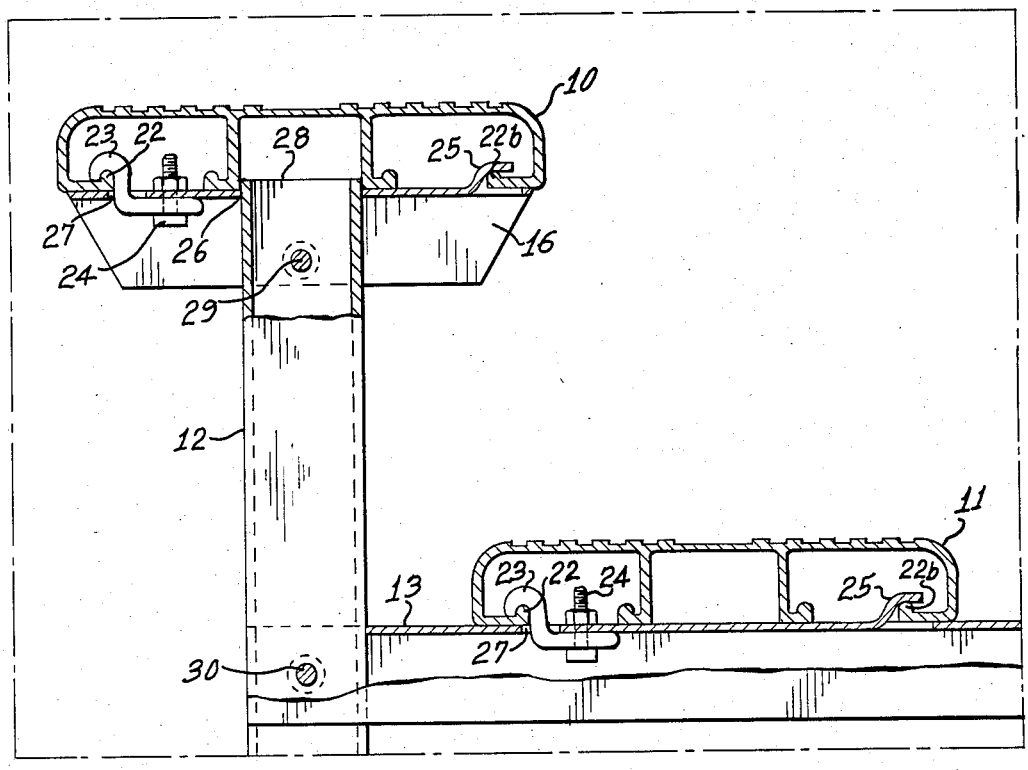
FIG. 4 is a cross sectional view in elevation of the portion so identified in FIG. 1.
Figure 5:
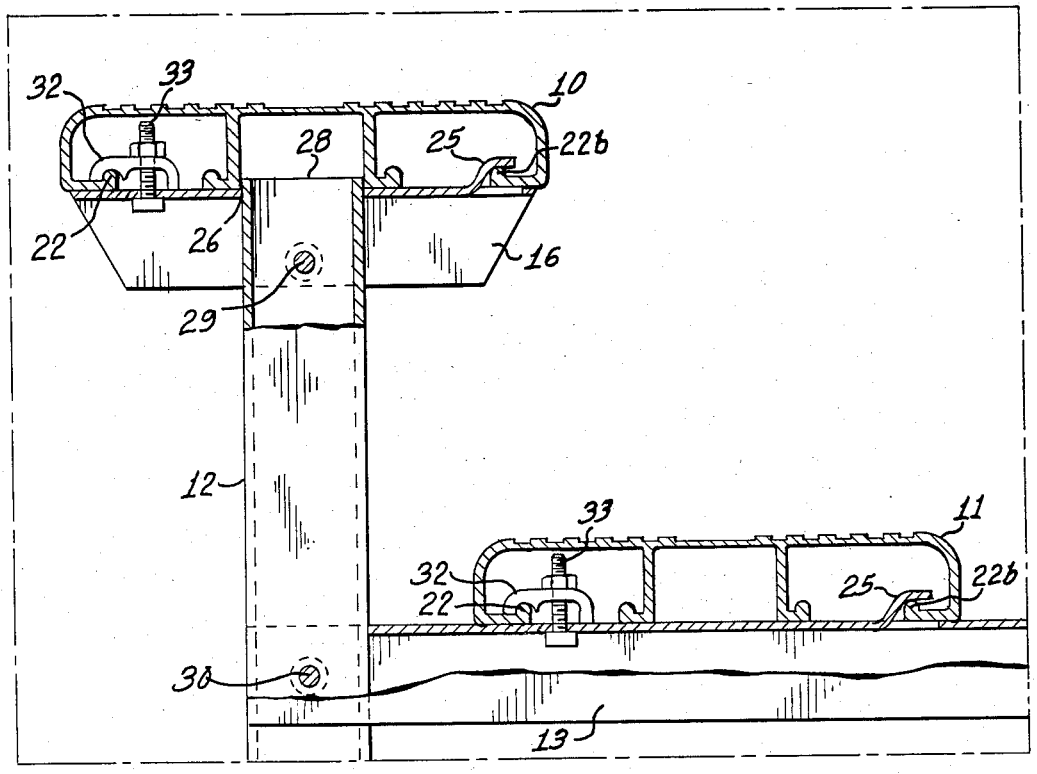
FIG. 5 is a cross sectional view in elevation of the portion so identified in FIG. 1.

In FIGS. 4 and 5 there are shown altenate embodiments of this invention as an enlargement of the portion identified in dotted lines on FIG. 1. These two embodiments differ solely in the design of the clip which holds the channel beam seat or footrest to the supporting structure. In FIG. 4 the clip 23 is an S-shaped member which fits over bead 22 and is fastened to the supporting structure by bolt 24. In FIG. 5 clip 32 fits over bead 22 and is fastened to the supporting structure by bolt 33. Other than these differences the two structures are identical. In both views there is shown seat member 10 resting on lateral cross support member 16 attached to the top of upright post 12 by means of bolt 29, and also channel beam footrest member 11 resting on crossbeam 13 which in turn is fastened to upright post 12 by bolt 30. Tab 25 is formed as an integral part of lateral cross support member 16 and of cross beam 13 by a cutting and forming operation well known in the metal fabrication industry. Tab 25 is formed so as to slide over bead **22*b* with a snug fit. Clip 23 is made with its operating end to fit snugly over bead 22 and to be fastened at its other end underneath the upper web of the support member upon which the channel beam 10 or 11 rests. This requires that the web be pierced by a suitable hole 27 to permit clip 23 to be threaded therethrough. Clip 23 is then fastened to that web by bolt 24** passing through a suitable bolt hole, shown or not shown on the drawings.

In FIG. 5 the same structure is involved as that described above with respect to FIG. 4 except that the clip holding the channel beam member 10 or 11 to its supporting structure is of a different design. In this instance clip 32 is generally of a U-shape or, more precisely an E-shape wherein the operating end of the clip is made to provide a snug fit over bead 22 and the other end rests on the top surface of the support member on which channel beam 10 or 11, respectively rests. In this instance there is no necessity for having a hole similar to 27 of FIG. 4; there is need only for a bolt hole to permit bolt 33 to be passed therethrough and to fasten the clip 32 tightly against the supported member.

In the structure shown in both FIGS. 4 and 5 lateral cross support member 16 is pierced by an opening 26 just slightly larger than the shape of upper extremity of upright post 12 to permit the upper end of post 12 to extend through the upper surface of member 16 as shown at 28. This feature provides stability to channel beam seat 10 in preventing it from tilting forward or backward around bolt 29 more than a very small amount. Hole 26 must be made as a sufficiently loose fit around the upper end of post 12 that it is not difficult to assemble seat member 10 onto the top of post 12, but on the other hand that fit must be close enough that only a minimum of tilting of seat member 10 will be permitted before the edge of hole 26 is jammed into the outside surface of post 12 to prevent further tilting. This feature is needed only for seat member 10 and is not required for obvious reasons for footrest member 11. An alternative to providing hole 26 is to employ two bolts 29 to attach a support member 16 to post 12.

Figure 6:
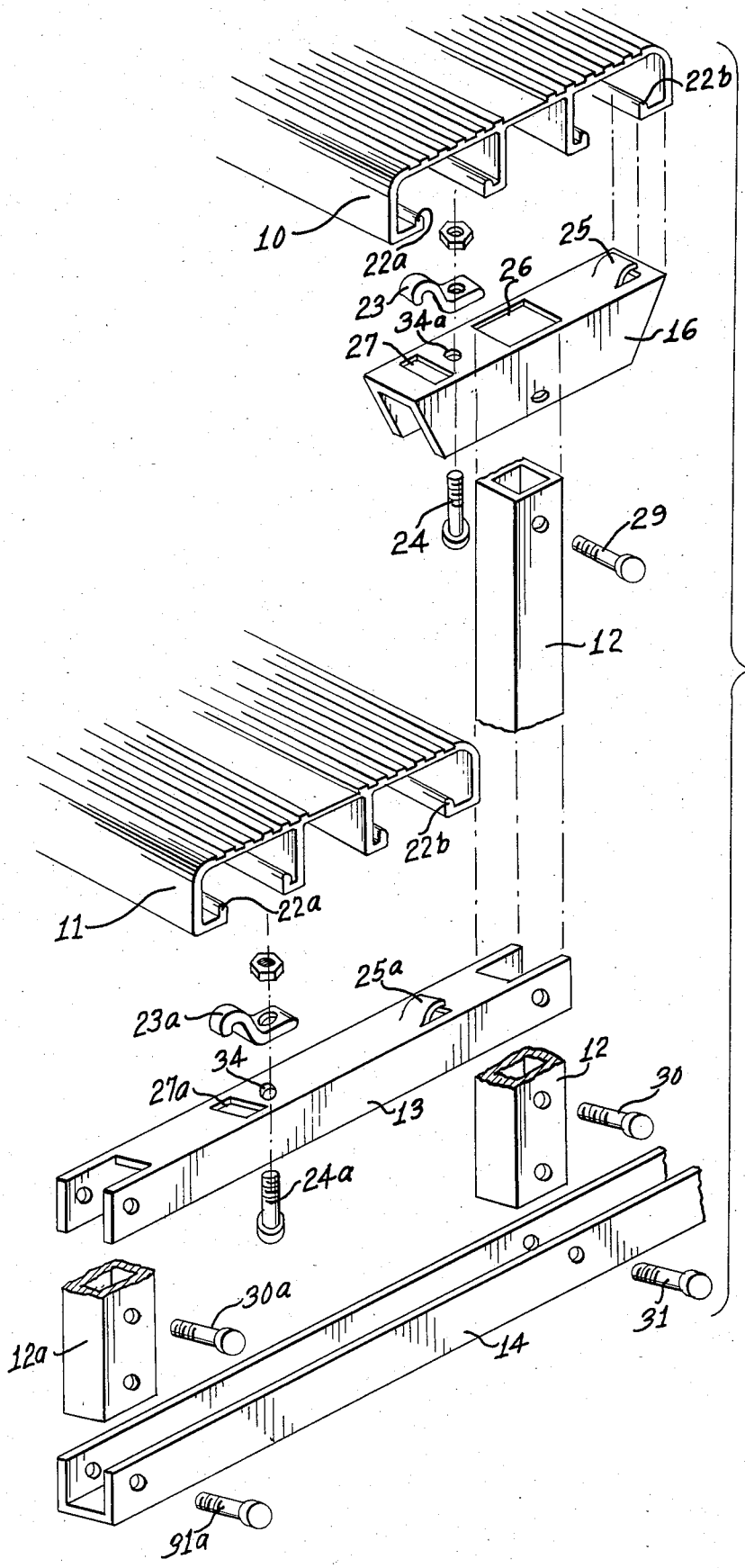
FIG. 6 is an exploded perspective view of the several components of the bleacher structure of this invention showing how they are assembled.

In FIG. 6 there is seen an exploded view of a portion of the bleacher structure of this invention employing S-shaped clip 23 as depicted in FIG. 4. It may be seen that base support beam 14 which rests on the ground is attached to upright posts 12 and **12*a* by bolts 31 and 31*a*, respectively. Crossbeam 13 is attached to posts 12 and 12*a*, respectively, by means of bolts 30 and 30*a*, respectively. Footrests member 11 rests upon crossbeam 13 and is attached thereto by means of tab 25*a* fitting over bead 22*b*, and held firmly in place by clip 23*a* fitting over bead 22*a* and being fastened to crossbeam 13 by bolt 24*a*. This view shows hole 27*a* through which the tail of clip 23*a* passed so as to place it underneath the upper web of crossbeam 13 and permitting it to be fastened by passing bolt 24*a* through bolt hole 34 and through the corresponding hole in the tail of clip 23*a*. Seat member 10 is similarly fastened to lateral cross support member 16 which is attached to the upper end of upright post 12 by means of bolt 29. Tab 25 fits over bead 2*b* and clip 23 fits over bead 22*a* and is then fastened to member 16. The tail of clip 23 is passed through through hole 27 to be on the underneath side of the upper web of member 16 and is then fastened down by means of bolt 24 passing through bolt hole 34*a* and through the corresponding hole in the tail of clip 23. The upper end of post 12 fits snugly through hole 26 which in this embodiment is made rectangular to fit the outer retangular perimeter of post 12**.

While the invention has been described with respect to certain specific embodiments, it will be appreciated that many modifications and changes may be made by those skilled in the art without parting from the spirit of the invention. It is intended, therefore, by the appended claims to cover such modifications and changes as fall within the true spirit and scope of the invention.

What is claimed as new and what is desired to secure by Letters Patent of the United States is:

1. In a bleacher structure having identical channel beams forming seat members and footrest members supported by an interconnected system of upright posts each having a rectangular cross section with their upper ends projecting through rectangular passageways in lateral cross support members, cross beams interconnecting adjacent posts, and diagonal members for stiffening the structure; said channel beams having an upper horizontal web portion and a plurality of spaced vertical leg portions depending from said web portion, including two outer leg portions positioned at the two outer extremities of said horizontal web portion, said leg portions terminating in lateral extending foot portions having lower bearing surfaces which are substantially coplanar, each said foot portion extending toward each other including an upwardly directed bead, said lateral cross support members and said cross beams each having upper bearing surfaces and lower surfaces therebeneath and an upwardly extending elongated tab having one end rigidly connected to and engaging respective said lateral cross support member or said cross beam and the opposite end being generally parallel to said lateral cross support member or said cross beam and positioned above said upper surfaces thereof and adapted to receive one of said beads in wedging engagement and pressing said one bead downwardly with its attached said foot portion being sandwiched against respective said upper surfaces of said cross support member or said cross beam, an elongated removable clip having two ends, one of said ends of said clip bearing directly upon said lateral cross support member or said cross beam and the other of said ends being adapted to receive the other of said beads and clamp said channel beam downwardly against said lateral support member or said cross beam, and fastening means to tighten said clip against lateral support member or said cross beam and simultaneously to urge said repsective other bead of said foot portion laterally outwardly into tight wedging engagement with said other end of said clip and pressing said other bead downwardly with its attached said foot portion being sandwiched against respective said upper surface of respective said cross support members or said cross beams.

2. The structure of claim 1 wherein said lower surfaces of said cross support members and said cross beams are flat, said clip one end is flat and engaged on one said lower surface, said one end and said cross support member or said cross beam include aligned holes therethrough, said fastening means passing through said aligned openings and having means to maintain said flat one end of said clip in contact with said flat lower surface.

3. The structure of claim 1 wherein said clip other end is curved and said clip one end is flat with a hole therein, said fastening means passing through said hole and an aligned hole in said lateral cross support member or said cross beam.

4. The structure of claim 3 wherein said fastening means is a threaded and headed bolt and nut threadedly engaged thereon and sandwiching therebetween said clip one end and said lateral cross support member or said cross beam, said nut and the head of said bolt engaging said clip and said upper surface of said lateral cross support member or said cross beam.

5. The structure of claim 3 wherein said lateral cross support member or said cross beam to which said clip is fastenable contains a passageway adapted to receive said clip therethrough to be fastened to said lateral cross support or said cross beam on said lower surface thereof and to be attached to said bead of said channel beam resting on said upper surface thereof.

6. The structure of claim 5 wherein said fastening means is a threaded and headed bolt and nut threadedly engaged thereon and sandwiching therebetween said clip and said lateral cross support member or said cross beam.

7. The structure of claim 1 wherein said clip is a U-shaped member with a hole in the central area therof to receive said fastening means therethrough.

8. The structure of claim 7 wherein said fastening means is a threaded and headed bolt and nut threadedly engaged thereon and sandwiching therebetween said clip with said one end engaging said upper surface of said lateral cross support member or said cross beam and said lateral cross support member or said cross beam, said nut and the head of said bolt engaging said clip and said lower surface of said lateral cross support member or said cross beam.

9. The structure of claim 7 wherein said upper surfaces are flat, said clip having two spaced apart legs, one said leg including a bead-receiving recess and the other said leg having a foot with a flat surface adapted to bear against said respective flat upper surface of said cross support member or said cross beam.

* * * * *